United States Patent [19]

Rohr et al.

[11] Patent Number: 4,696,246

[45] Date of Patent: Sep. 29, 1987

[54] DEVICE FOR DETECTING AN OVERLAPPING EDGE OF MATERIAL ON A SEWING MACHINE

[75] Inventors: Gustav Rohr, Heidelberg; Gerd Nohl, Rauenberg, both of Fed. Rep. of Germany

[73] Assignee: Frankl & Kirchner GmbH, Schwetzingen, Fed. Rep. of Germany

[21] Appl. No.: 868,790

[22] Filed: May 29, 1986

[30] Foreign Application Priority Data

Jun. 1, 1985 [DE] Fed. Rep. of Germany ..... 3519729

[51] Int. Cl.[4] ..... D05B 35/00

[52] U.S. Cl. ..... 112/272; 112/277; 250/561

[58] Field of Search ..... 112/272, 271, 275, 277, 112/104, 303, 121.11, 121.12; 250/548, 561, 571

[56] References Cited

U.S. PATENT DOCUMENTS

| | | | |
|---|---|---|---|
| 4,423,691 | 1/1984 | Schwaab | 112/272 |
| 4,565,140 | 1/1986 | Martell et al. | 112/272 X |
| 4,574,719 | 3/1986 | Balke | 112/272 |

FOREIGN PATENT DOCUMENTS

| | | | |
|---|---|---|---|
| 2652261 | 6/1977 | Fed. Rep. of Germany | 112/272 |

OTHER PUBLICATIONS

Reinecke, H., "Variostop-. . . ", Bekleidung Und Wasche, (Garments and Clothes), No. 7, 1970, pp. 466–470.

*Primary Examiner*—Peter Nerbun
*Attorney, Agent, or Firm*—Felfe & Lynch

[57] ABSTRACT

A device for detecting an overlapping edge of material on a sewing machine has, in combination, a signal-level discriminator and an optical waveguide. The optical waveguide has a light-receiving end on the sewing machine for receiving light through the overlapping edge of the material. The optical waveguide may be an optic fiber which, because of its small, flexible size can be accommodated easily even in the crowded sewing head or bed of an industrial sewing machine. The other end of the optical waveguide is remote from the light-receiving end for providing the received light to the signal-level discriminator which, therefore, is also remote from the crowded sewing head or bed of the sewing machine which, in addition, could interfere with its operation. For operation, the signal-level discriminator has an electro-optic sensor responsive to the light from the optical waveguide and a detector electrically responsive to light sensed by the electro-optic sensor for determining an absolute, light-intensity value of the sensed light which, therefore, detects the overlapping edge of the material accurately the corresponding change in determined light intensity.

20 Claims, 3 Drawing Figures

DEVICE FOR DETECTING AN OVERLAPPING EDGE OF MATERIAL ON A SEWING MACHINE

BACKGROUND OF THE INVENTION

The invention relates to a device for detecting an overlapping edge of material on a sewing machine and, more particularly, for detecting the edge of one layer of material, such as a patch pocket, overlapping another, larger layer of material, such as a garment, to stop an industrial sewing machine sewing the layers together at the edge.

When, as is frequently desired, a smaller piece of material, such as a patch pocket, for example, is to be sewn onto a larger piece of material, such as a garment, for example, it is necessary to stop at least the stitching mechanism and, generally, also the feeding mechanism of a sewing machine just before the edge of the smaller piece of material on the larger piece of material is reached to form a commercially-acceptable seam between the pieces. The high speed of industrial sewing machines makes this exacting and the complex and compact constructions of the sewing heads and beds of such machines makes it difficult to arrange sufficiently exacting devices at the sewing heads or beds, where required.

German patent publication OS No. 26 52 261 discloses a device for controlling an industrial sewing machine which detects obstructions in the material to be sewn, such as folds or the like, with a mechanical scanner contacting the material to be sewn. When the mechanical scanner detects an obstruction, it initiates a reaction according to a predetermined program in the driving (stitching and feeding) mechanism of the sewing machine. This device cannot detect an overlapping edge of a smaller piece of material being sewn onto a larger piece of material, however, because it is not an obstruction.

Devices having an emitter and a detector in positions for the detector to receive a reflection of radiation emitted by the emitter, generally on the sewing head above material being sewn on a sewing machine, are also known for controlling a sewing machine. These devices detect the edge of a piece of material on a support having a coefficient of reflection different from the material. This situation generally does not exist at an edge of one piece of material which overlaps another piece of material. The devices, are, therefore, not suitable for controlling a machine for sewing these together.

German Patent publication No. 33 23 214 discloses a device for controlling a sewing machine with transmitted light. It has two electro-optic sensors tandem along in the sewing direction and circuitry for scanning the signals of the sensors and supplying them to a frequency converter, a rectifier and, finally, a discriminator. In this manner, it is possible to detect the intensity difference which arises when one sensor is irradiated through one layer of material and the other sensor, through two layers of material, i.e., when an overlapping edge of one of the materials comes into the region between the two sensors. The circuitry for this is, however, very expensive and it is necessary to arrange both of the two sensors with appropriate connecting leads in the immediate vicinity of the sewing.

SUMMARY OF THE INVENTION

It is an object of the inventgion, therefore, to provide a device for detecting an overlapping edge of material that can be produced inexpensively, be used on a sewing machine substantially independently of the structure of the sewing machine by requiring little space for installation, for example, and enable absolute intensity values of transmitted light to be determined, i.e., requires only one sensory light receiver.

To this and other ends, the invention provides the combination of a signal-level discrimator, that is, a device for determining an absolute, light-intensity value, with an optical waveguide, that is, an optic fiber, for example. This makes it possible to detect the actual light-intensity away, that is, remote from the immediate vicinity of sewing in a sewing machine, for example. The detecting operation can, therefore—and this is of particular importance for detecting absolute values—take place substantially without disturbance from the sewing operation. This makes it possible to obtain absolute values from the signal-level discriminator with a high degree of operational dependability with inexpensive circuitry.

Because a known optic fiber with a diameter of, for example, 1 mm, can be laid with a radius of curvature of about 5 mm, moreover, the structure of the invention enables installation for detection, without problems, in almost any location desired and, specifically, even within the confined conditions of a sewing bed, below the sewing head of an industrial sewing machine. Only the light-receiving end of the optic fiber has to be in the sewing bed, the electro-optic sensor and the detecting circuitry of the signal-level discriminator connected to the other end of the optic fiber being spaced from the sewing bed by the optic fiber carrying the light for detection thereto.

Providing the light for detection from one end of an optical waveguide, e.g. an optic fiber, which receives the light from a source at its other end, as can also be done, enables the beam of the light for detection to be very close to the sewing needle of the sewing machine, even under the very confined conditions of the sewing head of an industrial sewing machine. This is advantageous for making the control limits from the light detection correspondingly close to the needle.

The optical waveguides can be mounted fixedly or non-fixedly to the sewing machine, for example, with the detection waveguide extending from the sewing bed and/or table of the sewing machine. A screw coupling or a plug-and-socket connection may be advantageously used in many cases for non-fixedly mounting the waveguides, If a simple, threaded sleeve is used, for example, it is possible to dismount either of the optical waveguides conveniently during initial installation or when the device of the invention or the device (sewing machine, for example) on which it is mounted has to be serviced. Obviously, retrofitting is also achieved easily in this manner.

Pulsed operation of the light source, and thus, its detection, preferably synchronized to the operation of the device on which the invention is used, as by a pulse generator on the main shaft usually found in an industrial sewing machine, for example, advantageously achieves the known advantages of pulses-mode operation. These are, for example, higher light-emission intensity and fewer breakdowns, i.e., longer light-source service life, especially when the device is synchronized with a machine used as intermittently as a sewing machine. Then, at least one timed light pulse is emitted only within each forward feed phase, that is, within each revolution of the main shaft of the sewing machine.

The device of the invention preferably also adapts the intensity of the light source to the thickness of the overlapping edge of material, that is, of the layers of material being sewn together when the device is so used. The light from the light source which is transmitted through these layers can then be at a lower intensity for thinner materials, thus prolonging the service life of the light source further.

The use of a laser light source enables the light beam to be transmitted reliably through several, thick layers of material to be sewn on a sewing machine and cooperates with an optical waveguide for projecting it onto the material. This makes evaluation of the absolute values of the intensity very good as compared to a conventional light source such as an infrared-emitting diode, for example, its intensity of light projection being too low for a reliable absolute-value evaluation.

The user of a laser light source has the additional advantage that the laser light is, by its nature, strictly monochromatic. By providing appropriate filters, for example, the influence of extraneous, ambient light, which always creates considerable problems for light detectors, can be eliminated completely.

BRIEF DESCRIPTION OF THE DRAWINGS

Further characteristic features, advantages and details of the invention will be seen from the following description of a merely-preferred embodiment which illustrates but does not limit the invention and is shown in drawings, wherein.

DESCRIPTION OF THE PREFERRED EMBODIMENT

Figure 1:
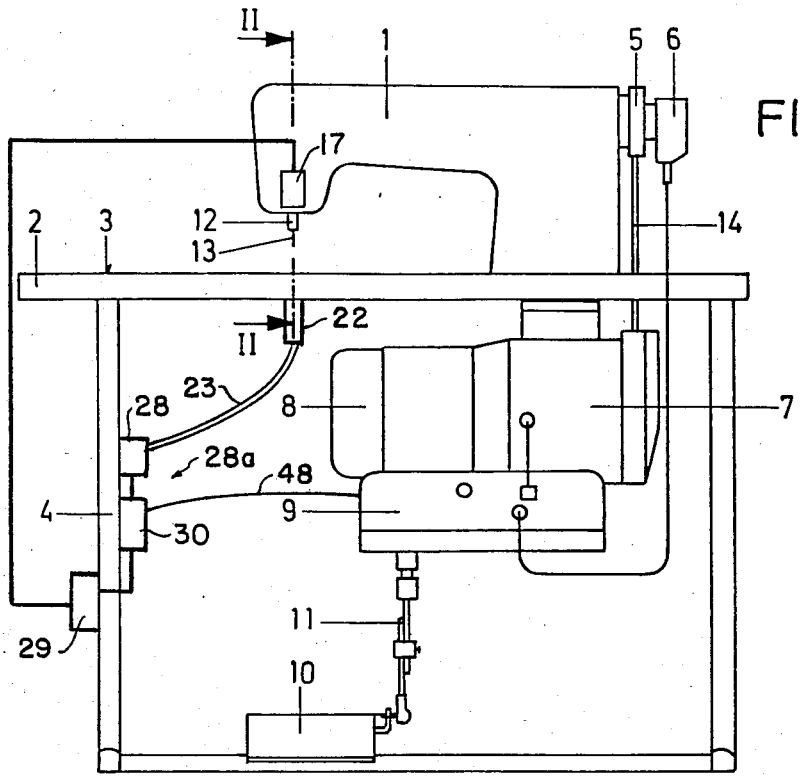
FIG. 1 is a schematic of the preferred embodiment on an industrial sewing machine.

An industrial sewing machine, as shown in FIG. 1 has a sewing head 1 on a sewing table. The side of the sewing table facing the sewing head, the upper side as shown in FIG. 1, defines a sewing plane. The sewing table and, thus, the sewing machine are supported on a frame 4.

The sewing head 1 of the sewing machine has a balance wheel 5 at one end. An electric pulse generator 6 is responsive to rotation of the balance wheel for generating electric pulses which are used to control the sewing machine, for example, the position of a needle bar 12 and needle 13 thereof. The needle bar and needle are on the other end of the sewing head from the balance wheel, but driven by rotation thereof.

A drive belt 14 rotatably connects the balance wheel 5 to a clutch-brake unit 7 which is controllably rotated by a constantly-rotating electric motor 8. In this embodiment, the motor is part of the clutch-brake unit which is supported on the sewing table. The rotation of the clutch-brake unit is controlled by a control 9 which is mounted on the clutch-brake unit. The control 9 is electrically connected to the pulse generator 6 and a switch (not shown) which is mechanically connected to a pedal 10 by rod linkage 11 for switching operation.

The construction and operation of such an industrial sewing machine are known. They are described, for example, in "*Bekleidung and Wäsche*" ("Garments and Clothes"), No. 7, 1970, pages 466 to 470.

FIG. 1 also shows the preferred embodiment on the industrial sewing machine. It has an optical waveguide 17 on the sewing head 1 at the needle bar 12 and needle 13 for projecting light parallel thereto to a coupling 22 holding the light-receiving end (24 in FIG. 2) of an optic fiber (optical waveguide) 23 for receiving light from the optical waveguide 17. The optic fiber 23 carries the light to a signal-level discriminator at 28*a* which is supported on the frame 4 remote from the sewing head 1 and motor 8 to be free from interfernce therefrom and avoid interference therewith and, more particularly, with the sewing head.

The signal level discriminator at 28*a* has an electro-optic sensor 28 responsive to the light from the optic fiber 23 and a detector 30 responsive to the sensor. For signal-level response to the sensor, the detector 30 is also connected to a control device 29 for a light source (18 in FIG. 2) which provides the light to the optical waveguide 17. The signal-level response of the detector is then provided to the control 9 for the sewing machine.

Figure 2:
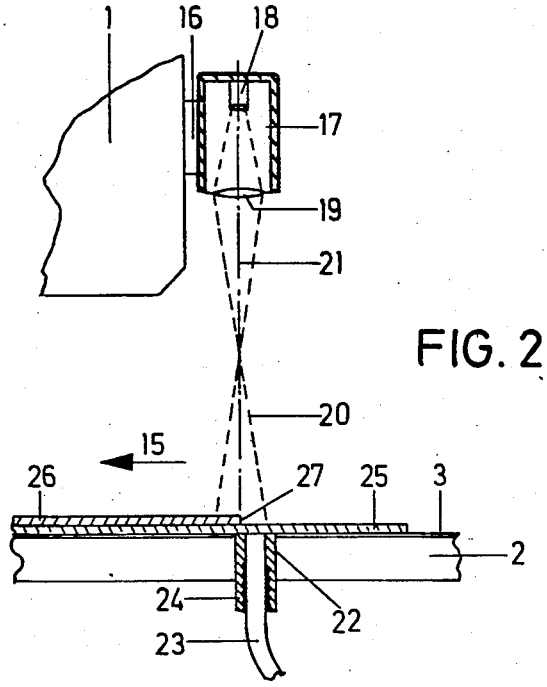
FIG. 2 is a cross section of a portion of the preferred embodiment and industrial sewing machine shown in FIG. 1 together with an overlapping edge of material to be sewn.

Arrow 15 in FIG. 2 indicates the direction superposed layers of material 25, 26 are moved for sewing together by the sewing head 1 of the sewing machine until an edge 27 of material layer 26 overlaps material layer 25 reaches the light-receiving end 24 of the optic fiber 23 in coupling 22. For this, an infrared-emitting laser 18, which may be a light-emitting diode in other embodiments, is mounted at one end of the optical waveguide 17 on the sewing head 1. The other end of the optical waveguide 17 has a lens 19 for projecting a beam of rays 20 along an axis 21 to the light-receiving end of the optic fiber in the coupling 22.

The coupling 22 is a sleeve detachably threaded into a hole in the sewing table 3. Accordingly, the layers 25, 26 of material guided on the upper side 3 of the sewing table 2 in the direction of sewing are illuminated. As the overlapping edge 27 of the layer 26 passes by the coupling, the intensity of the light transmitted through the layers into the light-receiving end 24 of the optic fiber 23 changes in proportion to the change in the thickness of the illuminated layers of material.

Figure 3:
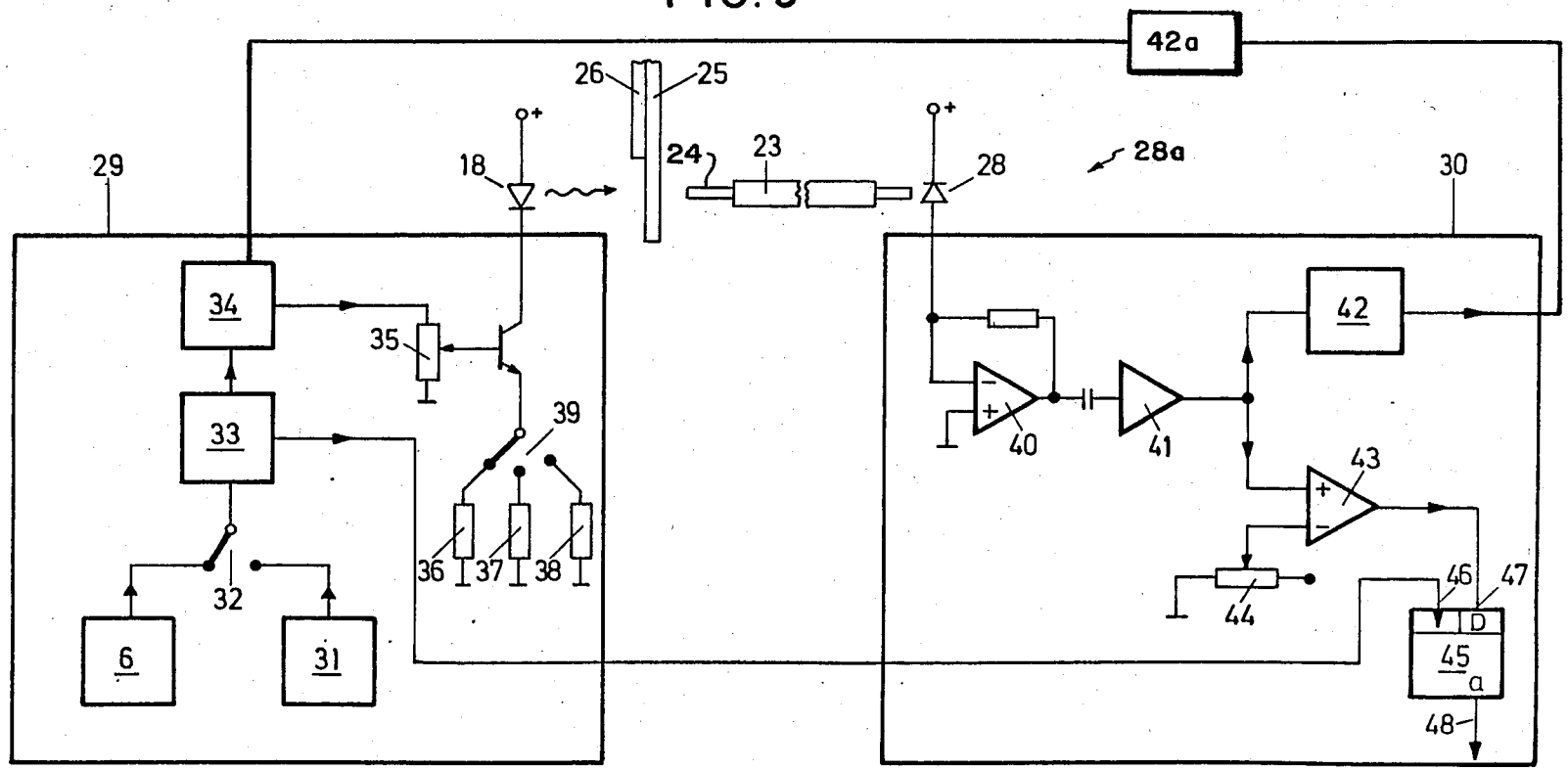
FIG. 3 is a more-detailed schematic of the preferred embodiment shown in FIG. 1 together with the overlapping material shown in FIG. 1.

FIG. 3 schematically shows how light from the light source 18', here shown as a light-emitting diode, transilluminates the layers of material 25, 26 into the light receiving end 24 of the optic fiber 23 on the other side of the material layers 25, 26. The light from the optic fiber 23 then reaches the electric-optic sensor 28, which is in the form or a photodiode aligned with this end of the optic fiber.

The control device 29 for the light source has a pulse generator 31 and a switch 32 by which the light source is operated in a pulsed fashion. When the switch 32 connects to the pulse generator 31, the pulsed operation is in an asynchronous mode. When the switch 32 connects to the pulse generator 6, as shown, however, the pulsed operation is synchronized to the operation of the sewing machine via the balance wheel and the main shaft (not shown) which connects it to the sewing instrumentalities of the sewing head.

The pulses from either pulse generator, depending upon the position of the switch, are fed by the switch 32 to a pulse shaper 33 and then to a series-connected light-source driver 34. The light source driver 34 is connected to the light source via circuitry having a resistor 35 for fine adjustment of the intensity of the light emitted by the light source and resistors 35, 36 and 38 of different values selected by a switch 39 for coarse adjustment of the intensity.

The detector 30 connected to the photodiode 28 has a preamplifier 40 and an amplifier 41 connected in series. A peak value detector 42 is fed from the amplifier 41 and feeds the control device 29 through adjusting circuitry 42a for equalizing the intensity of the light source.

For controlling the sewing machine, the amplifier 41 also feeds a comparator 43 which compares the amplified, sensed light signal from the photodiode 28 with a reference voltage from a variable resistor 44. The output of the comparator 43 and an output from the pulse shaper 33 in the control device 29 are connected to inputs 46, 47, respectively, of a storage and logic device 45 which emits a signal onto line 48 to the control 9 (as shown in FIG. 1) in dependence on the comparison of the signals at inputs 46, 47 of the storage and logic device 45.

The invention thus makes it possible to arrange the whole signal-level discriminator at 28*a* independently of and remote from the sewing instrumentalities of the sewing head 1 at a convenient location. The convenient location can, therefore, be selected for sufficient space both for the invention and so that, for example, the adjusting circuitry does not have to be separate from the detector 30.

It will be understood that the specification and examples are illustrative but not limitative of the present invention and that other embodiments within the spirit and scope of the invention will suggest themselves to those skilled in the art.

What is claimed is:

1. A device for detecting an overlapping edge of material on a sewing machine, comprising, in combination:

a signal-level discriminator having only one single electro-optic sensor responsive to light and a detector means electrically responsive to light sensed by the one electro-optic sensor for determining an absolute, light-intensity value of the sensed light; and an optical waveguide having a light-receiving end on the sewing machine for receiving light through the overlapping edge of the material on the sewing machine and an end remote from the light-receiving end for providing the received light to the one electro-optic sensor of the signal-level discriminator.

2. The device of claim 1, and further comprising a light source on the sewing machine for the light received by the light-receiving end of the optical waveguide, the light from the light source having a particular frequency spectrum.

3. The device of claim 2 wherein the frequency spectrum is infrared.

4. The device of claim 2, and further comprising a pulse generator responsive to operation of the sewing machine and means for pulsed operation of the light source in synchronism with the pulse generator.

5. The device of claim 3, and further comprising a pulse generator responsive to operation of the sewing machine and means for pulsed operation of the light source in synchronism with the pulse generator.

6. The device of claim 3, and further comprising means connecting the signal-level discriminator to the means for pulsed operation of the light source for operating the signal-level discriminator in synchronism with the light source.

7. The device of claim 5, and further comprising means connecting the signal-level discriminator to the means for pulsed operation of the light source for operating the signal-level discriminator in synchronism with the light source.

8. The device of claim 2, and further comprising means for operating the light source at variable light intensities.

9. The device of claim 3, and further comprising means for operating the light source at variable light intensities.

10. The device of claim 4, and further comprising means for operating the light source at variable light intensities.

11. The device of claim 5, and further comprising means for operating the light source at variable light intensities.

12. The device of claim 6, and further comprising means for operating the light source at variable light intensities.

13. The device of claim 7, and further comprising means for operating the light source at variable light intensities.

14. The device of claim 2, wherein the light source is a laser.

15. The device of claim 4, wherein the light source is a laser.

16. The device of claim 6, wherein the light source is a laser.

17. The device of claim 8, wherein the light source is a laser.

18. The device of claim 10, wherein the light source is a laser.

19. The device of claim 12, wherein the light source is a laser.

20. The device of claim 13, wherein the light source is a laser.

* * * * *